United States Patent [19]

Fillmore

[11] Patent Number: 4,678,082

[45] Date of Patent: Jul. 7, 1987

[54] VACUUM INDICATING THERMOPLASTIC CLOSURE

[75] Inventor: William E. Fillmore, Toledo, Ohio

[73] Assignee: Owens-Illinois, Inc., Toledo, Ohio

[21] Appl. No.: 884,244

[22] Filed: Jul. 10, 1986

[51] Int. Cl.[4] ..... B65D 41/04

[52] U.S. Cl. ..... 206/459; 206/524.8; 215/230; 215/271

[58] Field of Search ..... 215/271, 365, 230, 260; 206/459, 524.8, 525

[56] References Cited

U.S. PATENT DOCUMENTS

| | | | |
|---|---|---|---|
| 3,062,396 | 11/1962 | Foss et al. | 215/271 |
| 3,160,302 | 12/1964 | Chaplin | 215/271 |
| 3,836,033 | 9/1974 | Podesta | 215/276 X |
| 4,093,094 | 6/1978 | Smalley et al. | 215/276 |
| 4,616,761 | 10/1986 | Nolan | 215/271 |

*Primary Examiner*—Donald F. Norton
*Attorney, Agent, or Firm*—John R. Nelson

[57] ABSTRACT

A vacuum indicating thermoplastic closure for a container for the packaging of a vacuum-packed product, the top panel of the closure containing a circular inner portion which is connected to an outer annular portion by an inner annular portion with a circular hinge on the outside of the closure along a first interrupted line between the circular inner portion and the inner annular portion and another circular hinge on the inside of the closure along a second interrupted line between the inner annular portion and the outer annular portion to permit the circular inner portion to be moved relative to the outer annular portion from a first position which indicates the presence of a vacuum in the container to a second position which indicates the absence of a vacuum in the container without developing substantial tensile stresses in the top panel of the closure when the circular inner portion is in either such position, except for compressive stresses in the bridges formed by the interruptions in the first interrupted line and in the second interrupted line when the circular inner portion is in the first position, which compressive stresses assist in positively moving the circular inner portion from the first position to the second position upon the loss of vacuum in the container. Also, a package consisting of a container, a vacuum packed product contained in the container and such a closure in sealing and closing engagement with the container.

16 Claims, 5 Drawing Figures

VACUUM INDICATING THERMOPLASTIC CLOSURE

BACKGROUND OF THE INVENTION

1. Field of the Invention

This invention relates to a molded thermoplastic closure for a container for the packaging of a product under at least a partial vacuum, which closure has a portion whose position is altered by a loss of vacuum within the container to give a visual indication of such loss of vacuum.

2. Description of the Prior Art

Many food products which are packaged in glass jars are packaged under a partial vacuum to prevent spoilage or to preserve flavor, and it is important that the closure for such a container be able to seal the container properly to maintain the vacuum in the container until the first opening thereof. It has also been recognized that it is desirable for a closure for a container for a vacuum-packed product to incorporate means which will indicate the presence or absence of the desired degree of vacuum, and the prior art is familiar with metal closures which incorporate such a feature. For example, U.S. Pat. No. 4,093,094 (Smalley, et al.), which is assigned to the assignee of this application, describes a home canning closure in which the metal lid of a multi-piece closure incorporates a vacuum indicating button. The button in such a closure is deflected downwardly by the presence of a suitable degree of partial vacuum in the associated container, and because of the inherent elasticity of the closure, the deflected button will pop up to its normal position upon the release of the vacuum and the resulting repressurization of the container. U.S. Pat. No. 3,062,396 (G. J. Foss, et al), 3,836,033 (A. Podesta), and 3,160,302 (G. F. Chaplin), disclose one-piece metallic vacuum indicating closures that operate in a similar manner.

The use of a vacuum button or panel has heretofore been largely limited to metal closures or at least to closures with metal lids, however, and many of the plastic materials which have heretofore been widely utilized in the manufacture of container closures have not incorporated a similar vacuum indicating feature. The reason for this is that such plastic materials tend to be dimensionally stable only when they are under no appreciable load, and the distortion of a vacuum panel or button in the central panel of such a closure by virtue of the vacuum in the associated container would normally cause the central panel to gradually elongate (or creep) under the continued loading resulting from the vacuum. This problem could be aqgravated in the case of a container exposed to abnormally high temperatures, such as, for example, those prevailing in non-air conditioned warehouses during summer months, where filled containers are sometimes stored for prolonged periods of time. In a case such as this a clear pop-up of a stressed vacuum indicating panel in a plastic closure cannot be assured.

Co-pending U.S. patent application Ser. No. 673,063 of James F. Nolan, now U.S. Pat. No. 4,616,761, which is assigned to the assignee of this application, describes a vacuum indicating thermoplastic closure for a container for the packaging of a vacuum packed product. The central panel of the thermoplastic closure of the aforesaid James F. Nolan application has an interior portion which is integrally attached to an inner annular surrounding portion by means of a thin circular region of reduced thickness which acts as a hinge between the interior portion and the inner annular portion, and the central panel also has an outer annular portion and a second thin circular region of reduced thickness which acts as a hinge between the inner annular portion and the outer annular portion. Through the use of two circular hinges, as described, the interior portion is free to move up and down with respect to the rest of the thermoplastic closure under the influence of the vacuum in the associated container, or the lack thereof as the case may be, without developing significant levels of tensile stress in any portion of the closure panel, an important feature in a closure formed from a thermoplastic material, because of the tendency of such materials to gradually elongate (creep) under sustained loading. However, the closure of the aforesaid James F. Nolan application is so free of stress in its vacuum indicating position that there is no positive stress therein to cause the interior portion of the central panel thereof to raise to its vacuum non-indicating position, the movement of such interior portion being left primarily to pressure conditions in the head space of the associated container which can, in certain circumstances, lead to non-failsafe operating characteristics.

SUMMARY OF THE INVENTION

According to the present invention there is provided a closure for a container for a vacuum-packed product, which closure is made out of a thermoplastic material or at least has a central panel which is made out of a thermoplastic material. The closure central panel has an interior portion which is integrally attached to an inner annular surrounding portion by means of a thin interrupted circular region of reduced thickness, and this region acts as a hinge between the interior portion and the inner annular portion. The inner annular portion, in turn, is integrally attached to an outer annular portion by means of a second thin interrupted circular region of reduced thickness, and this second thin circular region functions as a hinge between the inner annular portion and the outer annular portion. Because of the presence of the two circular hinges in the closure, the interior portion of the closure will readily be drawn down into the headspace of the associated container by the presence of a vacuum therein, and it will indicate the presence of such vacuum by its position in a plane well below the plane of the outer annular portion of the closure. Additionally, the closure will be inherently dimensionally stable in this position because the deflected condition of the interior portion of the closure can be achieved without developing significant levels of tensile stress in any portion of the closure panel except in the interruptions in the thin circular regions of reduced thickness, which interruptions are of limited arcuate extent and, therefore, the closure will not deform or creep to the point that the interior portion will not reliably pop up due to the repressurization of the container headspace by a loss of vacuum therein.

The interruptions in the thin interrupted circular region of reduced thickness between the interior portion of the closure central panel and the inner annular surrounding portion are on the top side of the closure central panel and the interruptions in the thin interrupted circular region of reduced thickness between the inner annular surrounding portion of the closure central panel and the outer annular portion thereof are on the bottom side of the closure central panel. By this placement of the interruptions, both sets of interruptions are under compression loads when the closure central panel interior portion is in its lower or vacuum indicating position, and because of such compression loads, both sets of interruptions impart a memory to the closure central panel which will tend to return the closure central panel interior portion to its higher or nonvacuum indicating position upon the loss of vacuum in the container headspace, a factor which enhances the failsafe characteristics of such closure.

It is contemplated that a closure according to the present invention will have particular utility as a closure for widemouth food and beverage containers, particularly for infant formula and juice containers with a nominal finish diameter of 40 millimeters, a size which permits the product in the container to be dispensed through a standard nurser fitment, after removal of the original closure from the container.

Accordingly, it is an object of the present invention to provide a closure for a container for the packaging of a vacuum-packed product in which at least the central panel portion of the closure is formed from a thermoplastic material and incorporates a dimensionally stable portion which is movable in response to the presence or absence of vacuum in the container to indicate such condition, but which also contains portions that operate under compressive loads to positively bias such portion of the closure central panel portion to a position which indicates an absence of vacuum in the container, and it is also an object of the present invention to provide a package having such a closure in sealing engagement with a contaIner and a product packaged therein.

It is a further object of the present invention to provide a closure in which the central panel portion and depending skirt portion are molded in a single piece from a thermoplastic material and in which the central panel portion has an interiorly disposed portion which is movable in a dimensionally stable manner with respect to an outer annular portion when the closure is affixed to a container containing a vacuum-packed product to indicate the presence of a vacuum in the container, but which also contains portions that operate under compressive loads to positively bias such portion of the closure central panel to a position which indicates an absence of vacuum in the container, and it is also an object of the present invention to provide a package having such a molded thermoplastic closure in sealing engagement with a container and a product packaged therein.

It is also an object of the present invention to provide an improved package for the packaging of a beverage for infants, which beverage is packaged under vacuum or partial vacuum, and which package includes a novel and improved molded thermoplastic closure with a movable vacuum indicating central panel portion to provide a positive and failsafe indication of the loss of vacuum in such package.

For a further understanding of the present invention and the objects thereof, attention is directed to the drawing and the description thereof, to the detailed description of the invention and to the appended claims.

DETAILED DESCRIPTION OF THE PREFERRED EMBODIMENT

Figure 1:
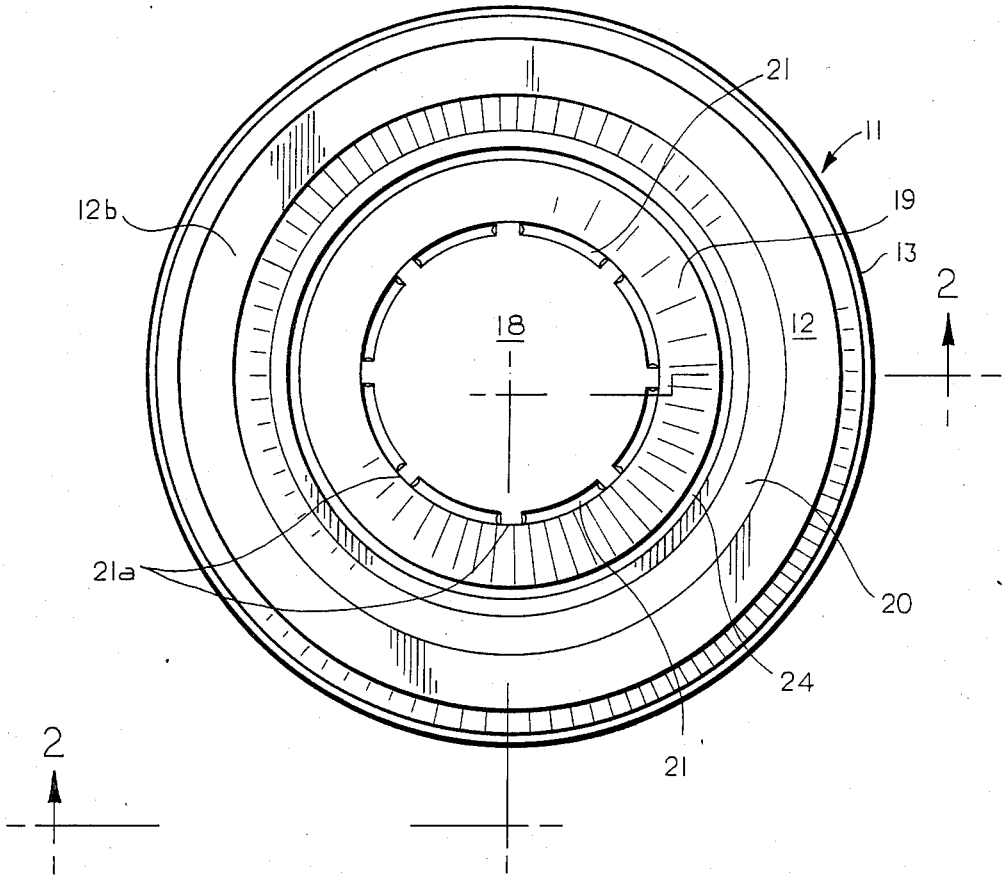
FIG. 1 is a top plan view of the preferred embodiment of a closure according to the present invention.
Figure 2:
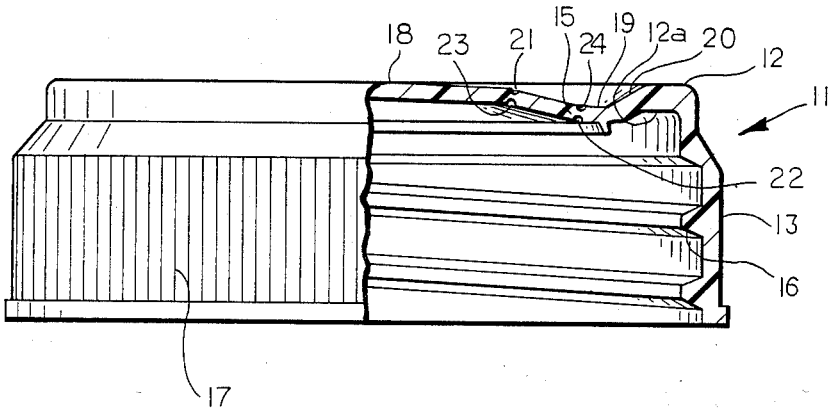
FIG. 2 is a sectional view taken on line 2—2 of FIG. 1.
Figure 3:
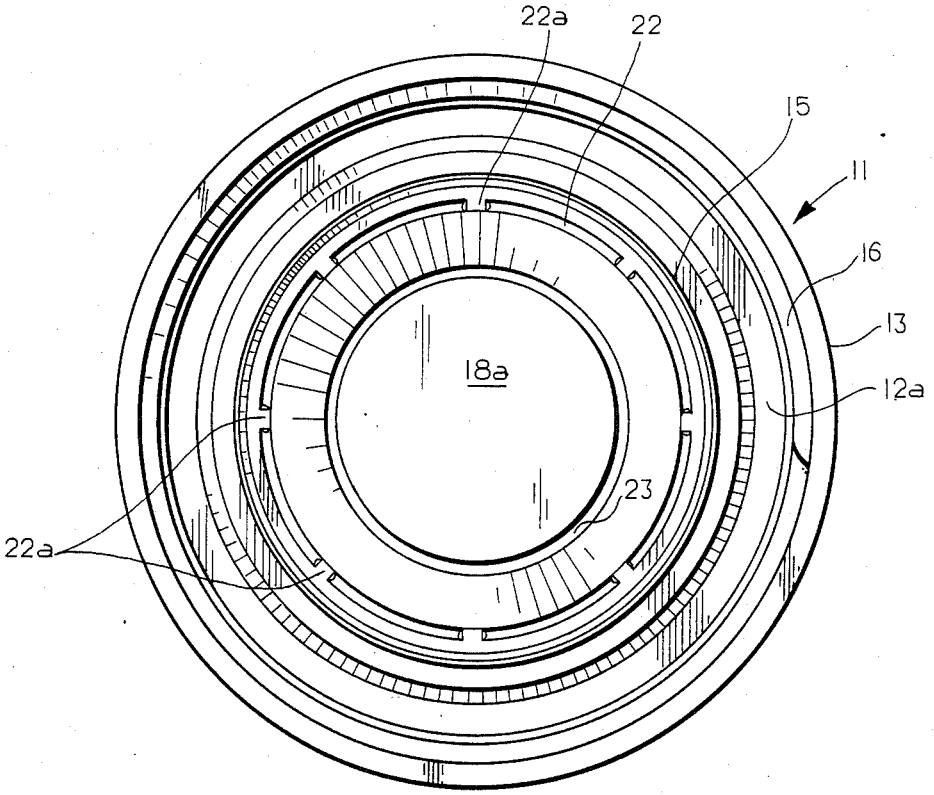
FIG. 3 is a bottom plan view of the closure of FIGS. 1 and 2.
Figure 5:
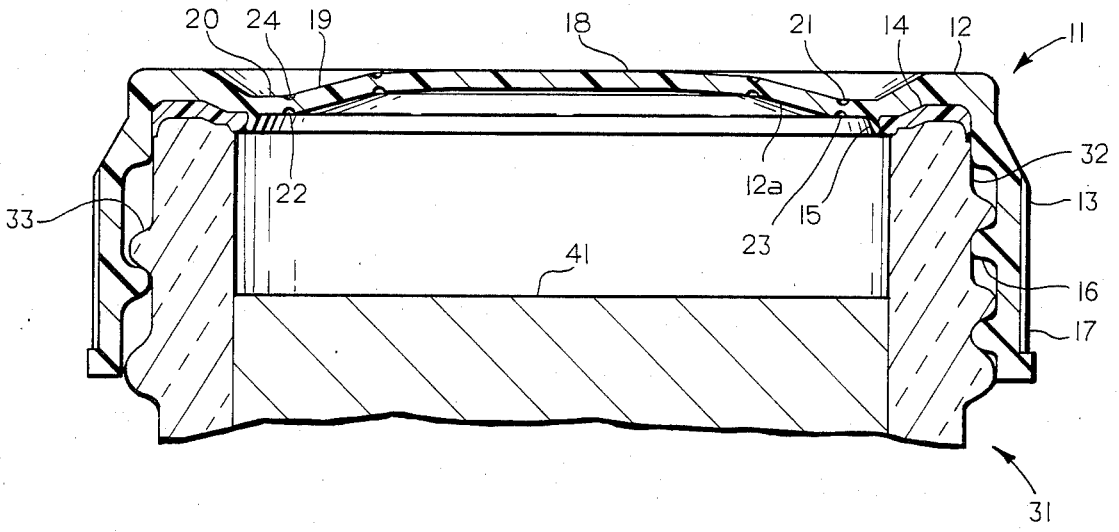
FIG. 5 is a view similar to FIG. 4 showing the closure of FIGS. 1 through 3 after the loss of vacuum in the container to which it is applied.
Figure 4:
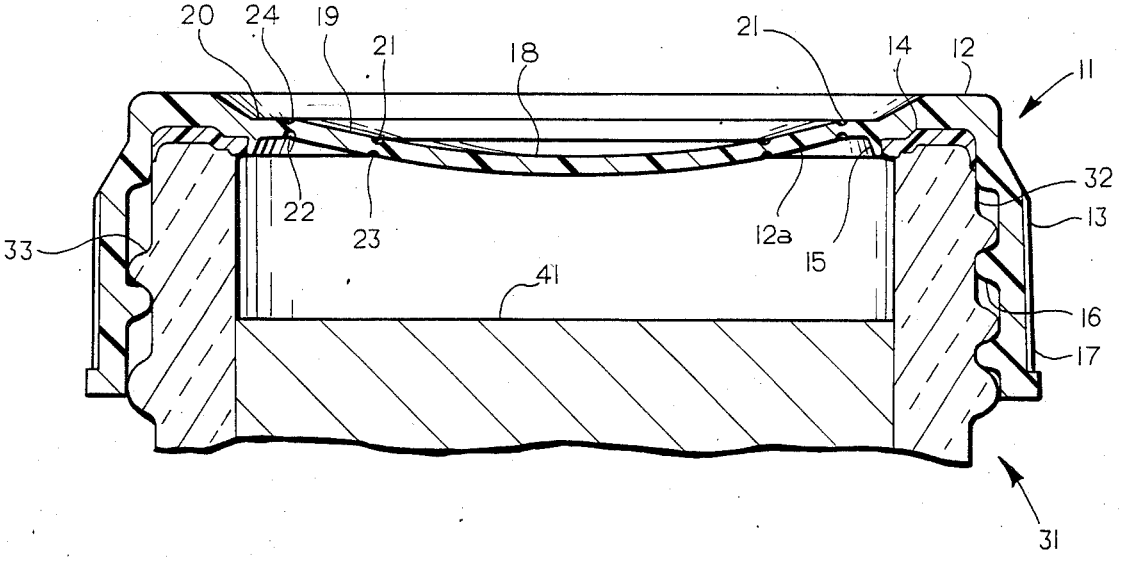
FIG. 4 is a fragmentary sectional view of the closure of FIGS. 1 through 3 as applied to the finish of a container which has a vacuum or partial vacuum therein.

A closure according to the present invention is indicated generally by reference numeral 11 in the drawing. The closure 11, as is shown in FIGS. 4 and 5, is adapted to be applied in closing relationship to a container, indicated generally by reference numeral 31, which is of a type that is suitable for the packaging of a food product or other product of a type which is advantageously packaged under sub-atmospheric pressure or partial vacuum conditions to prevent spoilage or preserve flavor. The packaged product is identified by reference numeral 41 in FIGS. 4 and 5. Typically, the container 31 may constitute a conventional wide mouth glass container, for example, the type of container which is used in the packaging of infant formula and juice products, a container which is usually provided with a finish diameter (the "T" dimension, or the nominal outside diameter of the container thread) of 40 millimeters, to accommodate a standard nurser fitment to be used in dispensing the product 41 from the container 31 after the removal of the closure 11 from the container 31.

As is shown in FIGS. 4 and 5, the container 31 is provided with a threaded neck or finish portion 32. However, it is contemplated that the closure of this invention can be utilized with containers with other types of finishes, for example, lug type finishes and snap-on bead finishes. In any case, the closure 11 has a generally horizontally disposed top portion 12, which spans the mouth of the container 31, and a vertically depending annular skirt portion 13. Additionally, the closure 11 is shown as having a sealing or gasket material 14 on the inside 12*a* of the top portion 12 at its juncture with the skirt portion 13, and this sealing material, for example a conventional ring of a plastisol sealing compound engages the top portion or rim of the finish 32 of the container 31 to help maintain the desired degree of vacuum therein. In the illustrated embodiment, a depending annular flange 15 is provided on the inside 12*a* of the top portion 12 of the closure 11 to help to retain the sealing or gasket material in its proper position. Of course, it is also contemplated that the vacuum-indicating feature of the closure 11, as hereinafter described in detail, can be utilized in closures of the linerless or self-sealing type, which are known in the prior art.

The depending skirt portion 13 of the closure 11 is sized to pass over the rim of the finish 32 of the container 31 and to extend downwardly over a thread 33 or other closure retaining means on the finish 32, and the retention is obtained by providing the inside of the depending skirt 13 of a closure 11 with an inwardly projecting thread 16, to engage the thread 33 on the container 31, in a known manner.

The closure 11, before the insertion of the gasket material 14 therein, is formed from a suitable semi-rigid thermoplastic material, for example, polypropylene or polypropylene filled with calcium carbonate for improved resistance to elevated temperatures of the type encountered in food product packaging operations, and can be readily formed in the illustrated one-piece version by injection molding or compression molding, as is well known in the art. When the closure is formed in this manner, it may be provided with serrations 17 in the outside surface of the skirt 13 to facilitate gripping of the closure during application and removal, and reapplication in the case of closures which are utilized on larger or multiple service containers. Where the product packaged in the associated container is oxygen sensitive, the underside of the closure may be provided with an appropriate barrier coating, not shown, or a barrier filler material may be added to the formulation of the thermoplastic material used in the manufacture of the closure.

The vacuum indicating feature of the closure 11 is obtained by providing the top portion 12 with a generally planar circular inner portion 18, an inner annular portion 19 which surrounds the circular inner portion 18 and an outer annular portion 20 which may be the outermost portion of the top portion 12 of the closure 11, the portion from which the annular skirt 13 depends. The material at the juncture of the circular inner portion 18 and the inner annular portion 19 is thinned on the outside **12*b* of the top portion 12 of the closure 11 along an interrupted circular line 21 with respect to the thickness of such portions to form a generally circular hinge with narrow, spaced apart bridges 21*a* therein. The interrupted circular hinge formed on the line 21 permits the circular inner portion 18 and the inner annular portion 19 to be flexed relative to one another without developing significant tensile forces in either of such portions, other than in the narrow, spaced apart bridges 21*a*. Similarly, the material at the juncture of the inner annular portion 19 and the outer annular portion 20 is thinned on the inside 12*a* of the top portion 12 of the closure 11 along an interrupted circular line 22 to form a generally circular hinge between these portions, with narrow, spaced apart bridges 22*a* therein, and these portions may, therefore, also be flexed relative to one another without developing significant tensile stresses in either of them, other than in the narrow spaced apart bridges 22*a***.

When the closure 11 is in its closing position on the container 31 containing a vacuum packed product 41, as is shown in FIG. 4, the subatmospheric or negative pressure in the unfilled portion of the container 31 above the top surface of the product 41, which is commonly referred to as the container "headspace", will draw the circular inner portion 18 of the top portion 12 of the closure 11 downwardly so that the plane of its top surface is below the plane of the top surface of the outer annular portion 20. If the vacuum in the headspace of container 31 should be broken, for example, by an opening or partial opening of the closure 11 or by a seal failure due to an irregularity in the top of the container finish or an improperly formed closure gasket, the headspace will draw in air from its surroundings and will become repressurized. This increase in pressure on the underside of the circular inner portion 18 of the top portion 12 of the closure 11 will move it or pop it upwardly into its other dimensionally stable position, as shown in FIG. 5, where the plane of the top surface of the circular inner portion 18 will be at a noticeably higher elevation, for example, approximately at the elevation of the top surface of the outer annular portion 20, as shown.

The return of the circular inner portion 18 of the top portion 12 of the closure 11 from the vacuum indicating position shown in FIG. 4 to the vacuum non-indicating position shown in FIG. 5 is assisted by the narrow, spaced apart bridges **21*a* in the interrupted circular line 21 and by the narrow, spaced apart bridges 22*a* in the interrupted circular line 22 because, in the FIG. 4 condition, the narrow, spaced apart bridges 21*a* and the narrow, spaced apart bridges 22*a* are under compression loads and, thereby, exert a biasing force which tends to move the circular inner portion 18 from the FIG. 4 position to the FIG. 5 position. Thus, the closure 11 has a structurally built-in "memory" feature which helps to impart failsafe operating characteristics thereto. Preferably, the closure 11 is also molded in the position depicted in FIG. 5 so that the residual stresses in the closure, sometimes referred to as the "memory" of a plastic product, wil1 also help to move it to the FIG. 5** or "up" position.

To increase the flexibility of the movement of the circular inner portion 18 of the top portion 12 of the closure 11 with respect to the outer annular portion 20, the inside **12*a* of the top portion 12 of the closure 11 is also provided with a continuous circular line 23 of reduced material thickness in alignment with the interrupted circular line 21 in the outside 12*b* of the top portion 12, and the outside 12*b* of the top portion 12 is also provided with a continuous circular line 24 of reduced material thickness in alignment with the interrupted circular line 22 in the inside 12*a* of the top portion 12. While the continuous circular lines 23 and 24 play no role in imparting "memory" to the closure 11 to enhance its failsafe operating characterisitics, they are useful in improving the ease of movement of the circular inner portion 18 with respect to the outer annular portion, especially in closures for widemouth containers that, inherently, must have a relatively thick top portion 12** or closures that are formed from relatively stiff thermoplastic materials, such as polypropylene or modified forms of polypropylene.

Through proper warnings or instructions on the closure 11 or the container 31 or in associated printed materials, a consumer or a retail store employee can be advised of any dangers which are associated with the use of the package which does not contain the desired vacuum at the time of the first opening, and can be instructed to determine how to readily determine the presence or absence of such vacuum by the position of the circular inner portion 18. Additionally, this feature can be utilized as a basis for continuous inspection of many filled containers in a packing plant where various types of electro-optical and electro-mechanical gaging equipment can be utilized to automatically read the position of the closure circular inner portion 18 and to discard any filled container 31 wnose closure 11 does not have its circular inner portion 18 in an acceptable position.

Although the best mode contemplated by the inventor for carrying out the present invention as of the filing date hereof has been shown and described herein, it will be apparent to those skilled in the art that suitable modifications, variations, and equivalents may be made without departing from the scope of the invention, such scope being limited solely by the terms of the following claims.

What is claimed is:

1. In combination with a container containing a vacuum-packed product therein and having a finish portion for receiving a closure to close and seal said container, a closure sealingly engaging the finish portion of said container, said closure comprising, in combination: a top portion spanning the finish of the container; and an annular skirt extending downwardly from the top portion over the upper portion of the finish and securely engaging said finish, said top portion being formed from a thermoplastic material and comprising a generally planar circular inner portion, said top portion further having an inside which faces toward said vacuum-packed product and an outside which faces away from said vacuum-packed product, a first annular portion surrounding said circular inner portion, said closure top portion being thinned on said outside along a first interrupted generally circular line between said circular inner portion and said first annular portion to form a first plurality of narrow, spaced apart bridges along said first interrupted generally circular line, and a second annular portion surrounding said first annular portion, said closure top portion, further, being thinned on the inside along a second interrupted generally circular line between said first annular portion and said second annular portion to form a second plurality of narrow, spaced apart bridges along said second interrupted generally circular line, said circular inner portion, said first annular portion and said second annular portion being integrally formed in one piece with said circular inner portion being hinged to said first annular portion along said first interrupted generally circular line and said first annular portion being hinged to said second annular portion along said second interrupted generally circular line, the plane of said circular inner portion being movable with respect to the plane of said second annular portion from a first position when there is a vacuum in said container to a second position when there has been a loss of the desired vacuum in said container, with the second position being higher in elevation than the first position when the container is in its normal upright position, said first plurality of narrow, spaced apart bridges and said second plurality of narrow spaced apart bridges being in compression when said circular inner portion is in said first position to assist in moving said circular inner portion to said second position upon said loss of the desired vacuum in said container.

2. The combination according to claim 1 wherein said first position is below the elevation of said second annular portion of said top portion of said closure when said container is in its said normal upright position.

3. The combination according to claim 2 in which the elevation of said second position is approximately at the elevation of said second annular portion of said top portion of said closure.

4. The combination according to claim 1 in which said top portion of said closure and said annular skirt of said closure are formed integrally with one another in one piece from said thermoplastic material.

5. The combination according to claim 4 wherein said thermoplastic material is selected from the group consisting of polypropylene and modifications of polypropylene.

6. The combination according to claim 5 in which said closure is formed by molding with said circular inner portion in said second position during molding.

7. The combination according to claim 1 wherein said closure further comprises a sealing compound on said inside thereof adjacent the juncture of said top portion and said annular skirt and wherein such sealing compound is in sealing engagement with said finish portion of said container.

8. The combination according to claim 1 wherein said closure top portion is further thinned along a first substantially continuous generally circular line on the inside thereof and is further thinned along a second substantially continuous generally circular line on the outside thereof, said first substantially continuous generally circular line being generally in alignment with said first interrupted generally circular line, said second substantially continuous generally circular line being generally in alignment with said second interrupted generally circular line.

9. A closure for sealingly engaging the finish portion of a container containing a vacuum-packed product, said closure comprising, in combination: a top portion adapted to span the finish of said container; and an annular skirt extending downwardly from said top portion and adapted to surround the upper portion of said finish portion and to securely engage said finish portion, said top portion being formed from a thermoplastic material and comprising a generally planar circular inner portion, said top portion further having an inside which is adapted to face toward said vacuum-packed product and an outside which is adapted to face away from said vacuum-packed product, a first annular portion surrounding said circular inner portion, said closure top portion being thinned on said outside along a first interrupted generally circular line between said circular inner portion and said first annular portion to form a first plurality of narrow, spaced apart bridges along said first interrupted generally circular line, and a second annular portion surrounding said first annular portion, said closure top portion being thinned on the inside along a second interrupted generally circular line between said first annular portion and said second annular portion to form a second plurality of narrow, spaced apart bridges along said second interrupted generally circular line, said circular inner portion, said first annular portion and said second annular portion being integrally formed in one piece with said circular inner portion being hinged to said first annular portion along said first interrupted generally circular line and said first annular portion being hinged to said second annular portion along said second interrupted generally circular line, the plane of said circular inner portion being movable with respect to the plane of said second annular portion from a first position when there is a vacuum in the container to a second position when there has been a loss of the desired vacuum in the container, with the second position being higher in elevation than the first position when the container is in its upright position, said first plurality of narrow, spaced apart bridges and said second plurality of narrow, spaced apart bridges being adapted to be in compression when said circular inner portion is in said first position to assist in moving said circular inner portion to said second position upon the loss of the desired vacuum in said container.

10. A closure according to claim 9 wherein said first position is below the elevation of said second annular portion of said top portion of said closure when said container is in its normal upright position.

11. A closure according to claim 10 wherein the elevation of said second position is approximately at the elevation of said second annular portion of said top portion of said closure.

12. A closure according to claim 9 wherein said top portion of said closure and said annular skirt of said closure are formed integrally with one another in one piece from said thermoplastic material.

13. A closure according to claim 12 wherein said thermoplastic material is selected from the group consisting of polypropylene and modifications of polypropylene.

14. A closure according to claim 13 wherein said closure is formed by molding with said circular inner portion in said second position during molding.

15. A closure according to claim 9 wherein said closure further comprises a sealing compound on said inside thereof adjacent the juncture of said top portion and said annular skirt and wherein said sealing compound is in sealing engagement with said finish portion of said container.

16. A closure according to claim 9 wherein said closure top portion is further thinned along a first substantially continuous generally circular line on the inside thereof and is further thinned along a second substantially continuous generally circular line on the outside thereof, said first substantially continuous generally circular line being generally in alignment with said first interrupted generally circular line, said second substantially continuous generally circular line being generally in alignment with said second interrupted generally circular line.

* * * * *